US007104068B2

(12) United States Patent
Moraes

(10) Patent No.: US 7,104,068 B2
(45) Date of Patent: Sep. 12, 2006

(54) TURBINE COMPONENT WITH ENHANCED STAGNATION PREVENTION AND CORNER HEAT DISTRIBUTION

(75) Inventor: Ricardo Ferreira Moraes, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 143 days.

(21) Appl. No.: 10/650,953

(22) Filed: Aug. 28, 2003

(65) Prior Publication Data

US 2005/0044856 A1 Mar. 3, 2005

(51) Int. Cl.
*F02C 1/00* (2006.01)
*F02G 3/00* (2006.01)

(52) U.S. Cl. ..... 60/752; 431/160; 165/168; 138/177

(58) Field of Classification Search ..... 60/730, 60/806, 39.83, 752–760; 431/160, 353; 165/168, 169, 134.1, 81, 83; 138/177, 38; 29/281.5, 283, 890.045
See application file for complete search history.

(56) References Cited

U.S. PATENT DOCUMENTS

| | | | | | |
|---|---|---|---|---|---|
| 594,998 | A | * | 12/1897 | Lyle | 138/157 |
| 742,453 | A | * | 10/1903 | Lake | 138/157 |
| 910,192 | A | * | 1/1909 | Joret | 138/38 |
| 1,429,252 | A | * | 9/1922 | Piette | 432/247 |
| 1,622,664 | A | * | 3/1927 | Murray et al. | 138/117 |
| 1,820,227 | A | * | 8/1931 | Keenan, Jr. | 165/168 |
| 1,928,009 | A | * | 9/1933 | Dornier | 138/177 |
| 2,385,127 | A | * | 9/1945 | Carlile | 429/163 |
| 3,081,795 | A | * | 3/1963 | Lesser | 138/177 |
| 3,412,761 | A | * | 11/1968 | Verrell et al. | 138/153 |
| 3,599,431 | A | | 8/1971 | Fonda-Bonardi | |
| 3,623,511 | A | * | 11/1971 | Levin | 138/39 |
| 3,648,920 | A | * | 3/1972 | Stump | 229/199 |
| 3,809,155 | A | * | 5/1974 | Anthony et al. | 165/133 |
| 3,941,157 | A | * | 3/1976 | Barnett | 138/115 |
| 3,960,208 | A | * | 6/1976 | Anthony et al. | 165/133 |
| 4,170,110 | A | | 10/1979 | Radin | |
| 4,297,842 | A | * | 11/1981 | Gerhold et al. | 60/776 |
| RE30,925 | E | | 5/1982 | Smith et al. | |
| 4,391,581 | A | * | 7/1983 | Daman et al. | 431/160 |
| 4,641,495 | A | | 2/1987 | Mowill | |
| 4,704,869 | A | | 11/1987 | Iizuka et al. | |
| 4,756,154 | A | | 7/1988 | Minardi et al. | |
| 4,928,385 | A | * | 5/1990 | Noguchi et al. | 29/788 |
| 4,982,492 | A | * | 1/1991 | Noguchi et al. | 29/446 |
| 5,167,116 | A | | 12/1992 | Koblish et al. | |
| 5,177,957 | A | | 1/1993 | Grieb | |
| 5,208,966 | A | * | 5/1993 | Noguchi et al. | 29/714 |
| 5,297,384 | A | | 3/1994 | Paxson | |
| 5,379,806 | A | * | 1/1995 | Matthews et al. | 138/149 |

(Continued)

*Primary Examiner*—William H. Rodríguez

(57) ABSTRACT

Aspects of the invention relate to a system for reducing stagnation between substantially adjacent components while providing enhanced heat distribution properties in the corners and edges of the components. Each component is generally hollow and has two walls disposed substantially orthogonal to each other. Each of the two walls includes a substantially planar region, having an associated thickness, that transitions into a corner region. The two walls join in the corner region to form an outer edge portion and an inner edge portion. The interior surface of each wall in the corner region approaches the exterior surface as the interior surface advances toward the inner edge portion such that the thickness in the corner region does not exceed the thickness of the substantially planar region. The components are substantially adjacent such that the outer edge portions are disposed opposite and substantially parallel to each other.

15 Claims, 6 Drawing Sheets

U.S. PATENT DOCUMENTS 5,435,139 A * 7/1995 Pidcock et al. ..... 60/757
5,469,894 A * 11/1995 Gandia et al. ..... 138/172
5,568,722 A 10/1996 Brunner et al.
5,581,994 A 12/1996 Reiss et al.
5,586,431 A 12/1996 Thonebe et al.
5,660,212 A * 8/1997 Elder ..... 138/157
5,735,126 A * 4/1998 Schulte-Werning ..... 60/732
5,737,922 A * 4/1998 Schoenman et al. ..... 60/752
5,996,645 A * 12/1999 Hosokawa et al. ..... 138/177
6,012,493 A * 1/2000 Remke et al. ..... 138/38
6,092,555 A * 7/2000 Otsuka ..... 138/118
6,164,075 A * 12/2000 Igarashi et al. ..... 60/752
6,173,561 B1 * 1/2001 Sato et al. ..... 60/772
6,174,159 B1 * 1/2001 Smith et al. ..... 431/7
6,477,843 B1 2/2002 Schroeder et al.
6,434,943 B1 8/2002 Garris
6,460,859 B1 * 10/2002 Hammi et al. ..... 277/596
6,510,683 B1 1/2003 Lawlor
6,606,861 B1 * 8/2003 Snyder ..... 60/752
6,732,528 B1 * 5/2004 Akagi et al. ..... 60/752
6,810,673 B1 * 11/2004 Snyder ..... 60/752
6,814,106 B1 * 11/2004 Iizuka ..... 138/163
6,832,484 B1 * 12/2004 Hofmann et al. ..... 60/752
6,837,050 B1 * 1/2005 Mandai et al. ..... 60/725
2003/0116213 A1 * 6/2003 DiMarco ..... 138/114

* cited by examiner

TURBINE COMPONENT WITH ENHANCED STAGNATION PREVENTION AND CORNER HEAT DISTRIBUTION

FIELD OF THE INVENTION

The invention relates in general to turbine components that operate in high temperature flow environments and, more particularly, to components configured to minimize flow stagnation near such components and to provide enhanced heat distribution characteristics.

BACKGROUND OF THE INVENTION

There are various applications in which one or more components can be exposed to high temperature flow conditions. For instance, many of the components in the combustor section of a turbine engine operate in such an environment. Such components can include head end plates, which are used to close off the combustor chamber, and can further be used to help centralize and align adjacent burners. An example of a head end plate 50 is shown in FIG. 3. Often, a plurality of head end plates 50 are aligned, radially or laterally, side-by-side along the combustor ring 56 as shown in FIG. 4.

Usually, such components contain internal cavities or passages through which a coolant can pass to provide relief from the extremely hot temperatures on the outside. Further, these components may also include sundry coatings to provide additional heat resistance. Despite these measures, there are two recurring problems associated with head end plates. One problem is that of low flow or stagnation zones substantially proximate to the head end plate. The other problem is that of superheated fluids, such as combustion gases, lingering near the head end plates and other components; prolonged exposure to these gases can result in part failure due to high thermal loads, especially at the corners and edges of these components which can act as heat sinks.

There are known methods for minimizing stagnation zones around adjacent components. One general example of such an arrangement is shown in FIG. 1. In this example, a plurality of components 10 having sharp edges and/or corners, such as substantially 90 degree edges 12, are positioned substantially adjacent to each other such that the sharp edges 12 of each component 10 are substantially opposite and parallel to each other. While minimizing the likelihood of stagnation, the components 10 are nevertheless subjected to the high temperatures of combustion, and such a configuration can still result in unacceptably high thermal loads.

As will be described below, the edges and the corners 12 shown in FIG. 1 constitute relatively thicker portions of the component 10. Referring to FIG. 2, assuming the side walls 14 of the component 10 have a substantially uniform thickness x and that the side walls meet at substantially right angles to form an edge 12, then the thickness of the edge would be about $x\sqrt{2}$. If three side walls of a component with a thickness x meet at substantially right angles to each other then a corner is formed with a thickness of about $x\sqrt{3}$. Thus, the corner and edge portions 12 are relatively thicker than the side walls 14 extending away from the corner and edge portions 12. In these areas of greater thickness, convective heat transfer occurs more slowly between coolant supplied to the interior 13 of the component 10 and the superheated gases impinging on the exterior 15 of the component 10.

Consequently, the corners and/or edges 12 act somewhat like heat sinks and become a potential failure point for the component 10.

Numerous configurations, as shown in FIGS. 5A–5D, have been advanced to address the problems of flow stagnation or hot spots at the corners and edges of the components. Referring to FIG. 5A, one design includes two or more components 18 having curved edges/corners 20 such that a constant wall thickness is maintained. This design suffers from the disadvantage that it does not eliminate or reduce the stagnation zone. One improvement is shown in FIG. 5B. This configuration still includes curved edges 22 but now holes 24 are provided in the corners or edges 22 to allow a portion of the internal cooling air to leak into the stagnant flow zone. While such a design helps in minimizing the stagnation zone proximate to the component, it is not always desirable to bleed cooling air, depending on the particular system at hand.

Referring to FIG. 5C, yet another design maintains the outer corners and edges 26 at a substantially 90 degree angle so as to substantially reduce the stagnation zone. However, the components 30 are made from thinner materials such that the walls 28 are thinner than usual (using FIG. 2 as a reference point, the thickness of these component walls would be something less than x). Despite being thinner, the corners and edges 26 of the components 30 are still thicker relative to the component walls 28, and experience has shown that these corners and edges 26 still create unacceptable localized hot spots.

Yet another approach is to chamfer the outer corner or edges 32 of the component as shown in FIG. 5D. This configuration allows for the corner/edge 32 to be made to an acceptable thickness. However, like the curved corner/edge 20 design in FIG. 5A, the chamfered corner/edge 32 design departs from the 90 degree sharp corner configuration and, therefore, flow stagnation remains a concern.

None of the previously designs have successfully addressed both problems of flow stagnation and the undesirable heat concentrations that can occur at corners and/or edges of components exposed to high temperature flow environments. Thus, one object according to aspects of the present invention is to provide a system for such components that not only provides enhanced heat distribution properties at corner and/or edges regions but also avoids the problem of stagnant flow. These and other objects according to aspects of the present invention are addressed below.

SUMMARY OF THE INVENTION

Aspects of the present invention relate to system for reducing flow stagnation between substantially adjacent components while also enhancing heat distribution characteristics of the components, especially at the corners and/or edges of the components so as to minimize or avoid localized hot spots. The system includes a first component and a second component. Both the first and second components are generally hollow, and component has at least two walls disposed substantially orthogonal to each other. Each of the two or more walls has an interior surface and an exterior surface.

Further, each of the two walls includes a substantially planar region transitioning into a corner region. Each substantially planar region has an associated wall thickness. The exterior surfaces of the two walls join in the corner region to form an outer edge portion. The outer edge portion can culminate in a substantially 90 degree edge, or it can culminate in a substantially rounded edge. The interior surfaces of the two walls join in the corner region to define an inner edge portion. In the corner region, the interior surface of each wall approaches the exterior surface such that the edge thickness, that is, the distance between the inner edge and the outer edge, is less than or equal to the wall thickness.

The first and second components can be substantially adjacent such that the outer edge portions are disposed opposite and substantially parallel to each other. The first and second components can be disposed substantially laterally adjacent to each other. Alternatively, the first and second components can be disposed substantially circumferentially adjacent to each other. As a result, the adjacent outer edges reduce the stagnation of air flow around the first and second components, while the reduced thickness of the corner region provides enhanced heat transfer properties.

The first and second components can be turbine engine components such as head end plates for closing off at least a portion of the combustion chamber of the turbine engine. The hollow interior of the first and second components can be supplied with cooling air or other coolant, and the exterior surfaces of the walls of the first and second components can be exposed to high temperature gases.

In another respect, aspects of the invention can be applied to a component to enhance thermal distribution properties, independent of flow stagnation prevention. The component includes a generally hollow body having two walls disposed substantially orthogonal to each other. The component can be substantially rectangular. The substantially hollow body can have an inner volume that is supplied with a coolant. Each of the two walls has an interior surface and an exterior surface. Further, each of the two walls includes a substantially planar region transitioning into a corner region.

Each substantially planar region has an associated wall thickness, and the planar region of the two walls can have substantially identical thicknesses. The exterior surfaces of the two walls join in the corner region to form an outer edge or corner portion. The outer edge portion can culminate in a substantially 90 degree edge portion or in a substantially rounded edge portion. The two interior surfaces of the two walls join in the corner region to define an inner edge or corner portion. The interior surface of each wall in the corner region approaches the exterior surface as the interior surface advances toward the inner edge portion such that the thickness in the corner region does not exceed the thickness of the substantially planar region.

DETAILED DESCRIPTION OF EMBODIMENTS OF THE INVENTION

Aspects of the present invention relate to turbine components having one or more features that can avoid flow stagnation while also enhancing heat distributions at the corners and/or edges of the components to minimize or avoid localized hot spots. Aspects of the present Invention improve upon previous turbine component designs that failed to solve both problems.

Embodiments of the invention will be explained in the context of a head end plate for a turbine engine, but the detailed description is intended only as exemplary. Aspects according to the present invention can be applied to other situations in which two or more substantially adjacent components are subject to a superheated environment. Embodiments of the invention are shown in FIGS. 6–8, but the present invention is not limited to the illustrated structure or application.

Figure 6:
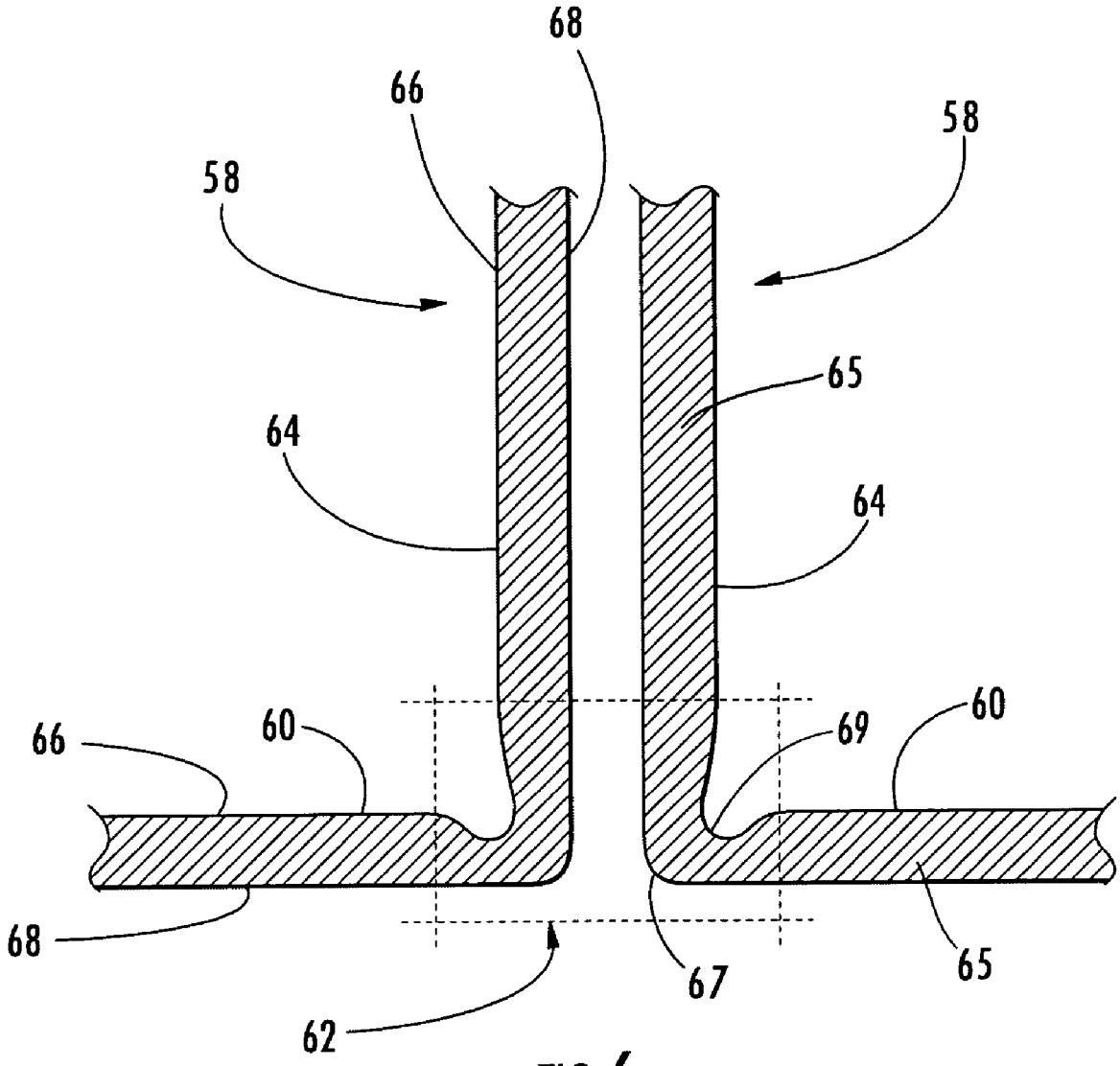
FIG. 6 is a cross sectional view of an edge configuration for a component according to aspects of the present invention.
Figure 7:
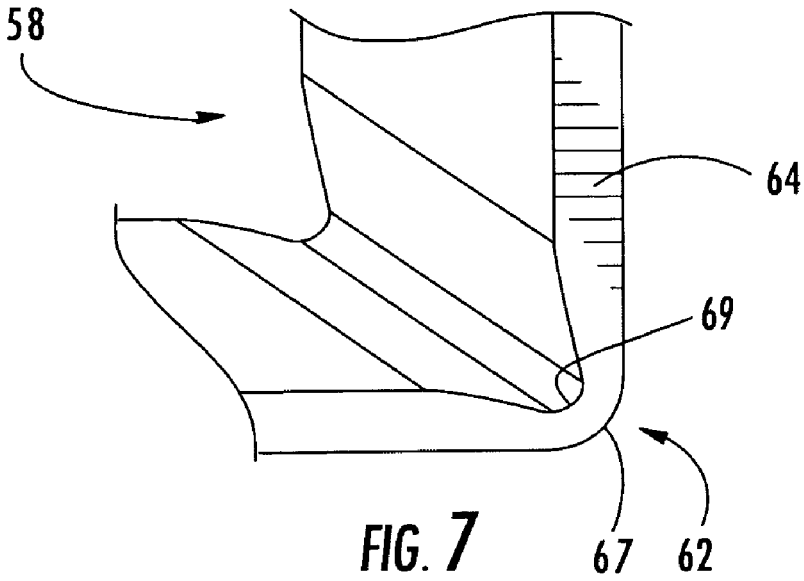
FIG. 7 is an isometric view of an edge configuration for a component according to aspects of the present invention.
Figure 8:
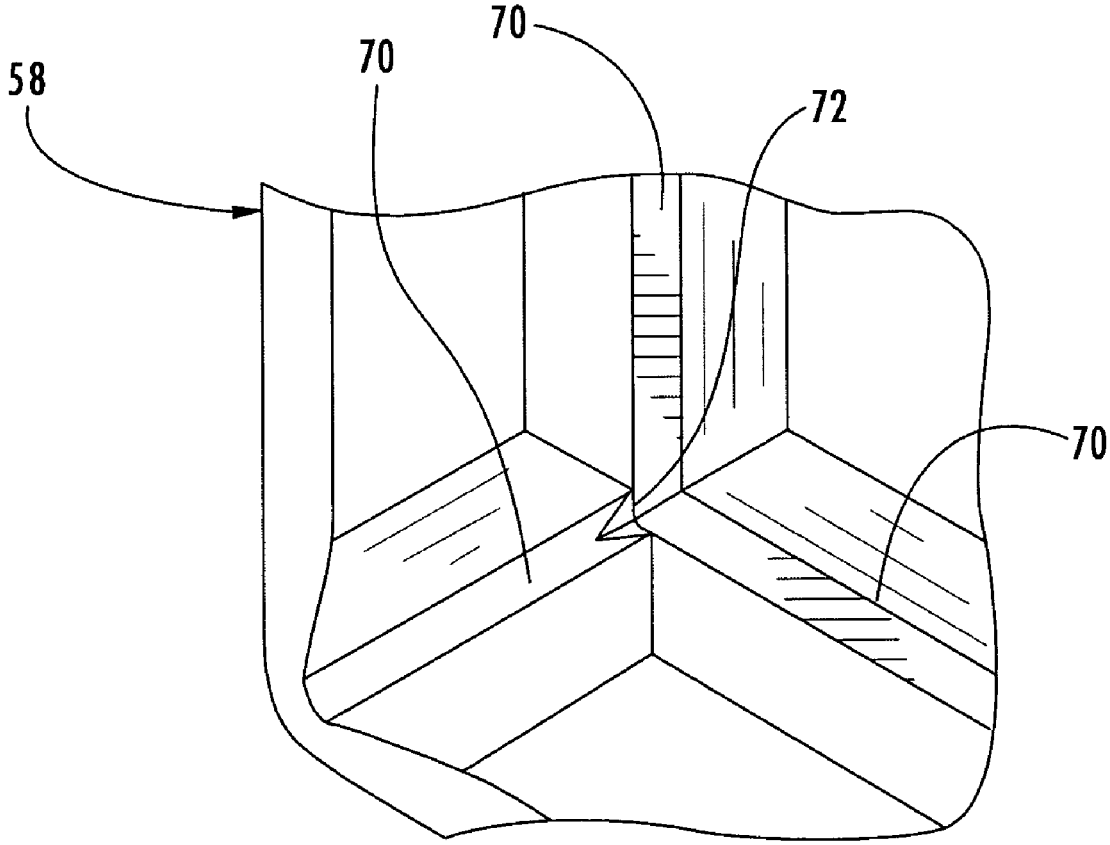
FIG. 8 is an isometric view of a component in which multiple edges and/or corners are configured according to aspects of the present invention.

Aspects of the present invention can be applied to any generally hollow body 58 having at least two walls 60,64 disposed substantially orthogonal to each other (FIGS. 6–7). Each of the two walls 60,64 can have an interior surface 66 and an exterior surface 68. Further, each of the two walls 60,66 can include a substantially planar region 65, having an associated wall thickness, that transitions into a corner region 62. The substantially planar region 65 need not span the entire length of the walls 60,66; instead, there can be a localized planar region 65 adjacent to the corner region 62.

In the corner region 62, the exterior surfaces 68 of the two walls 60,64 join to form an outer edge portion 67. Also, in the corner region 62, the interior surfaces 66 of the two walls 60,64 join to define an inner edge portion 69. The interior surface 66 of each wall 60,64 in the corner region 62 approaches the exterior surface 68 as the interior surface 66 advances toward the inner edge portion 69 such that the thickness in the corner region 62 does not exceed the thickness of the substantially planar region 65.

Such an arrangement can provide enhanced heat distribution characteristics to the edge regions of a component. For example, a component having an edge configured according to aspects of the invention can achieve a temperature gradient between the inner and outer edges that is approximately 47% to 63% less than an edge without a reduced thickness according to principles of the invention. In absolute terms, the gradient reduction can range from about 56 to 99 degrees Celsius. The degree of the benefit can depend on the material thickness as well as on the location of the head end plate, such as whether it is located on the hot side or the cold side of the annular ring 56.

In one embodiment, the planar region 65 of the walls 60,64 can be of substantially identical thickness. However, when the planar regions 65 are of unequal thickness, then it is preferred if the thickness of the corner region 62 does not exceed the thickness of the smaller of the two substantially planar regions 65.

The outer edge or corner portion 67 can have a variety of configurations. For example, the outer portion 67 can culminate in a substantially 90 degree sharp edge. Alternatively, the outer edge portion 67 can culminate in a substantially rounded edge.

In one embodiment, the component 58 can be substantially rectangular in conformation (see FIG. 8); in such case, some or all of the interior corner portions 72 and edge portions 70 can be configured as described above. Aspects of the invention have been described in connection with the juncture of two walls, but they can be applied to the junction of three walls as well, such as would occur in the corner 72 of a rectangular component 58.

Such an arrangement can provide enhanced heat distribution characteristics to the corner 72 of a component. For example, a component having a corner configured according to aspects of the invention can achieve a temperature gradient between the inner and outer sides of a corner that is approximately 68% to 78% less those of a corner without a reduced thickness according to principles of the invention. In absolute terms, the gradient reduction can range from about 84 to 153 degrees Celsius. Again, the magnitude of the benefit can depend at least on the material thickness as well as on the location of the head end plate, such as whether it is located on the hot side or the cold side of the annular ring 56.

The component 58 can have a substantially hollow body that includes an inner volume. The inner volume can be supplied with a coolant. The coolant can be air, steam or other suitable fluid. The component 58 can be made of various materials including Hastalloy X or Inconel 939 (weldable version).

A component 58 having aspects according to the present invention can be made in a variety of ways. For example, the component 58 can be cast to have features according to aspects of the present invention such as having the interior surface 66 of each wall 60,64 in the corner region 62 approach the exterior surface 68 as the interior surface 66 advances toward the inner edge portion 69 so that the thickness in the corner region 62 does not exceed the thickness of the substantially planar region 65. Alternatively, the edge configurations according to aspects of the invention can be added to a component 58 using secondary processes such as machining, laser drilling or other material removal process. Again, these are merely examples of methods in which aspects of the present invention can be applied to a component.

Figure 1:
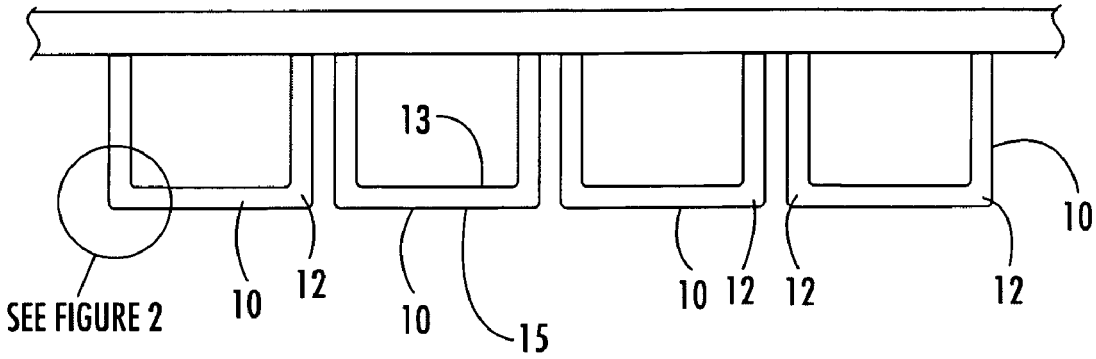
FIG. 1 (PRIOR ART)
FIG. 1 is a cross-sectional view of a general arrangement of adjacent components.
Figure 2:
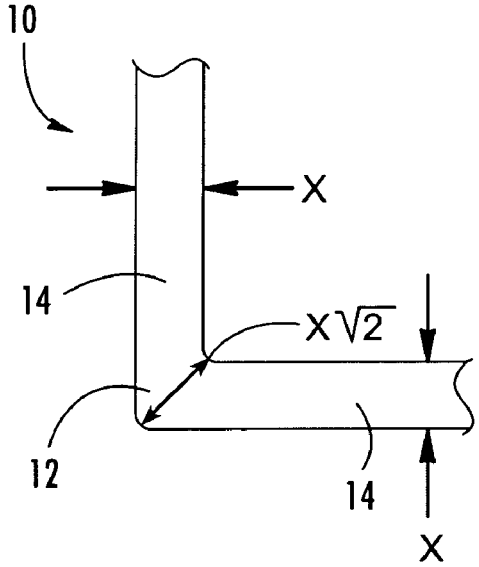
FIG. 2 (PRIOR ART)
FIG. 2 is close-up view of an edge portion of a component showing the thickness of the corner region being greater that the thickness of the side walls.
Figure 3:
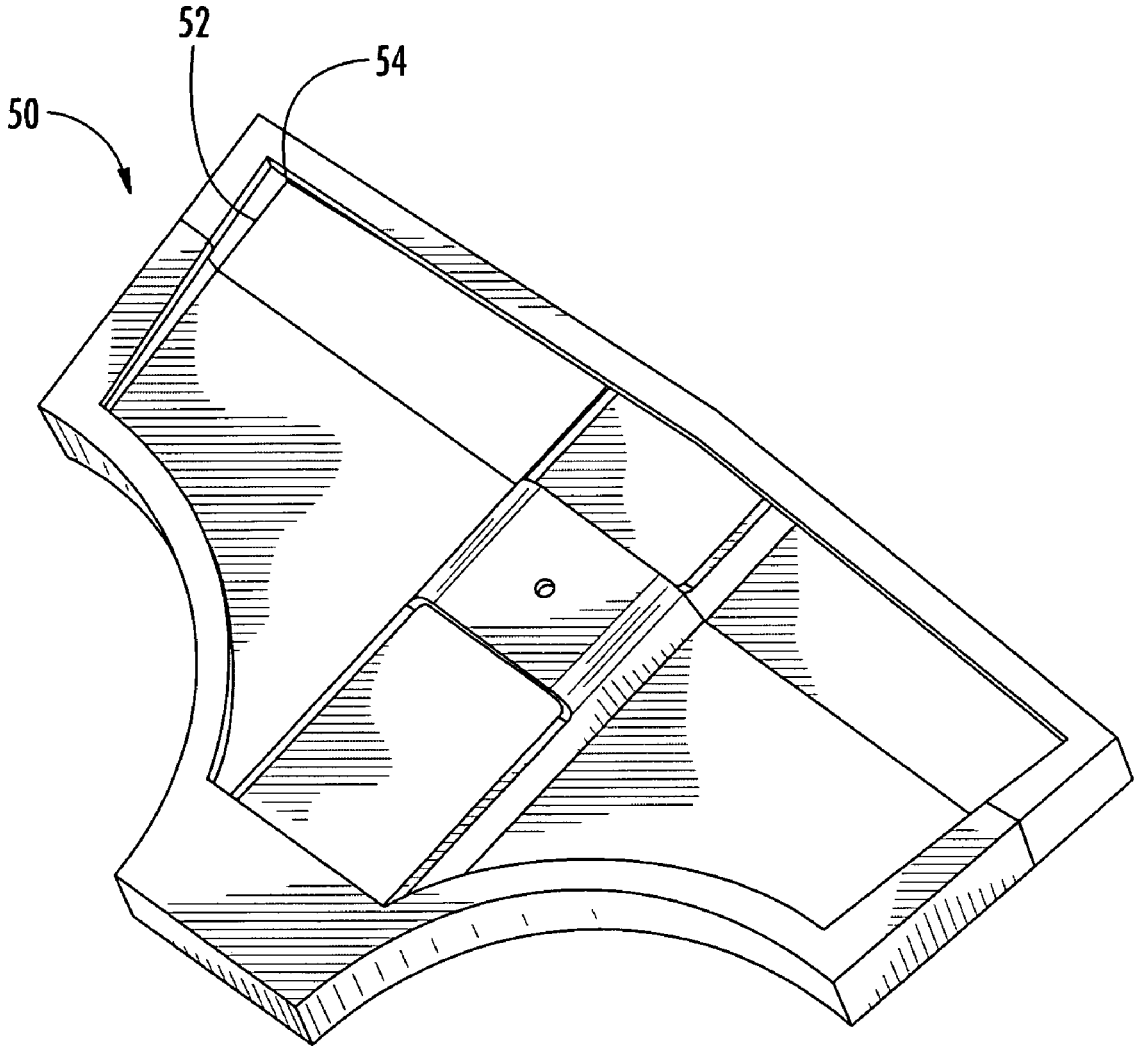
FIG. 3 (PRIOR ART)
FIG. 3 is an isometric view of a head end plate.
Figure 4:
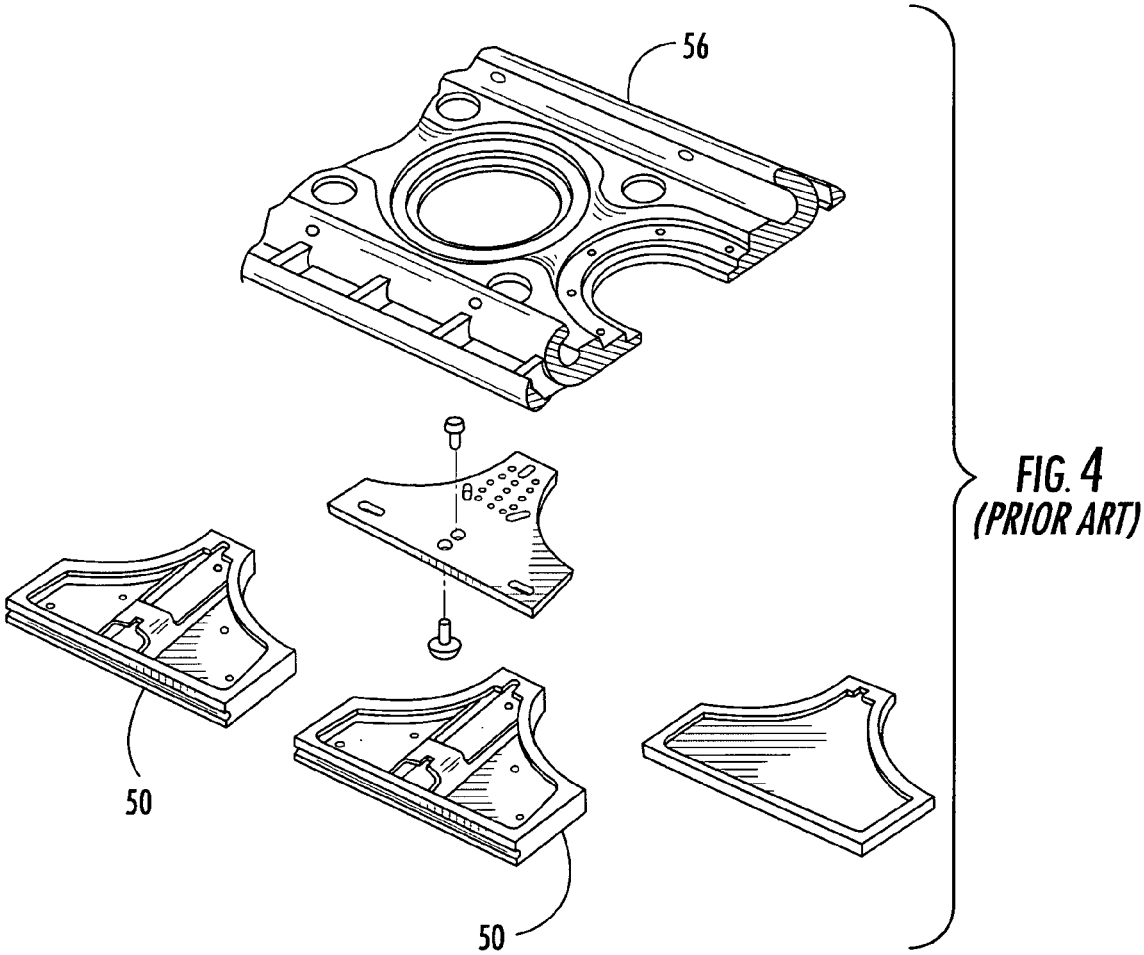
FIG. 4 (PRIOR ART)
FIG. 4 is an exploded isometric view of a portion of an annular combustor in which a head end plate can be used.
Figure 5A:
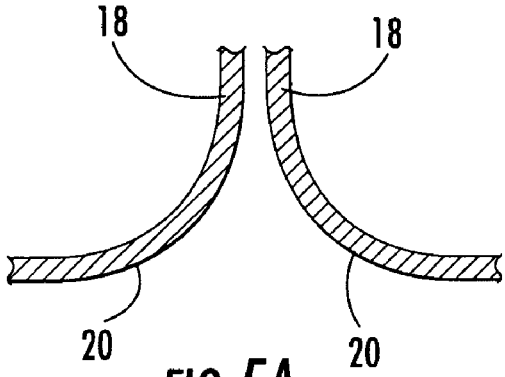
FIG. 5A (PRIOR ART)
FIG. 5A is a cross-sectional view of a prior configuration for a corner or edge portion of a head end plate.
Figure 5B:
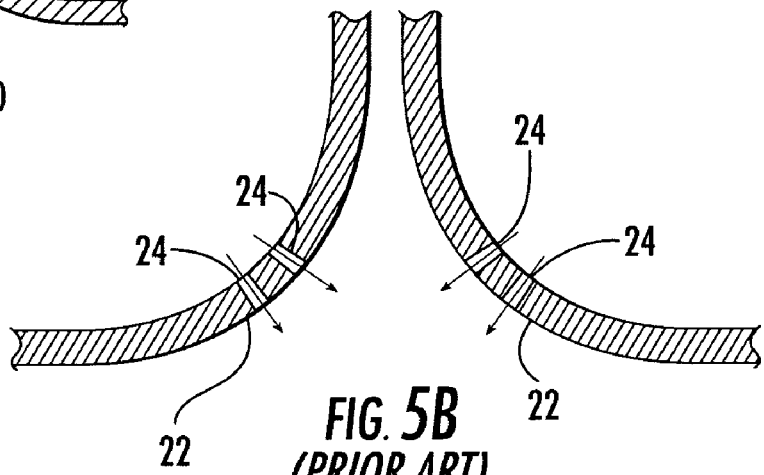
FIG. 5B (PRIOR ART)
FIG. 5B is a cross-sectional view of a prior configuration for a corner or edge portion of a head end plate.
Figure 5C:
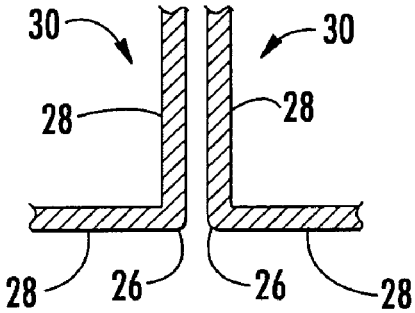
FIG. 5C (PRIOR ART)
FIG. 5C is a cross-sectional view of a prior configuration for a corner or edge portion of a head end plate.
Figure 5D:
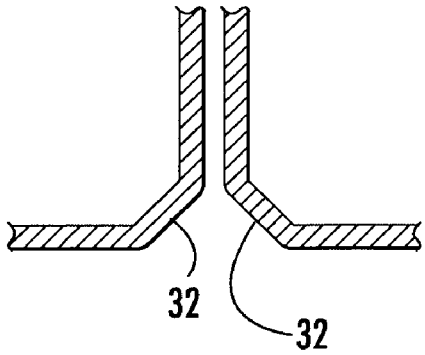
FIG. 5D (PRIOR ART)
FIG. 5D is a cross-sectional view of a prior configuration for a corner or edge portion of a head end plate.

A component having aspects according to the present invention can be used in a number of ways. For example, aspects of the present invention can be applied to one or more head end plates 50 in a turbine engine (FIG. 3) such as along interior edges or corners 52,54. A set of head end plates 50 can surround each burner of the combustor with the head end plates 50 being aligned side-by-side (see FIG. 4). In the case of an annular combustor, the head end plates 50 can be aligned substantially circumferentially adjacent to each other along an annular ring 56. In other applications, the head end plates 50 or other components can be disposed laterally adjacent to each other.

Regardless of the application, two or more components 58 are provided having at least one corner region 62 configured according to aspects of the present invention. The components 58 are substantially adjacent such that the outer edge portions 67 are disposed opposite and substantially parallel to each other (FIG. 6). Thus, the adjacent outer edges 67 reduce stagnation of air flow around the components 58 and the contour of the interior surface 66 of each wall 60,64 provides enhanced heat transfer between the hot exterior gases and the coolant supplied to the interior of the components.

Though aspects of the present invention have been discussed in connection with head end plates, one skilled in the art will appreciate how to apply aspects of the present invention to other turbine engine components and still other components outside of the turbine engine context. Thus, it will be understood that the invention is not limited to the specific details described herein, which are given by way of example only, and that various modifications and alterations are possible within the scope of the invention as defined in the following claims.

What is claimed is:

1. A system for reducing flow stagnation between substantially adjacent components and enhancing heat distribution of the components comprising:

a first component and a second component, each of the first and second components being generally hollow and having at least two walls adjoining each other in a corner region, each of the at least two walls having an interior surface and an exterior surface, each of the at least two walls including a substantially planar region transitioning into the corner region, each substantially planar region having a wall thickness, wherein the exterior surfaces of the two walls join in the corner region to form an outer edge and the interior surfaces of the two walls join in the corner region to form an inner edge, the distance between the inner edge and the outer edge defining an edge thickness, wherein, in the corner region, the interior surface of each wall approaches the exterior surface such that the edge thickness is less than or equal to the wall thickness, and wherein the first and second components are substantially adjacent such that the outer edges are disposed opposite and substantially parallel to each other, whereby the adjacent outer edges allows reduce stagnation air flow around the first and second components and the edge thickness in the corner region that is less than or equal to the wall thickness provides enhanced heat transfer properties.

2. The system of claim 1 wherein the first and second components are turbine engine components.

3. The system of claim 1 wherein the first and second components are head end plates, whereby the head end plates close off at least a portion of the combustion chamber of a turbine engine.

4. The system of claim 1 wherein the first and second components are disposed substantially laterally adjacent to each other.

5. The system of claim 1 wherein the first and second components are disposed substantially circumferentially adjacent to each other.

6. The system of claim 1 wherein a coolant is supplied to the hollow interior of the first and second components.

7. The system of claim 1 wherein the exterior surfaces of the component walls are exposed to high temperature gas flow.

8. The system of claim 1 wherein the outer edges culminate in a substantially 90 degree edge.

9. The system of claim 1 wherein the outer edges culminate in a substantially rounded edge portion.

10. A system for reducing flow stagnation between substantially adjacent components and enhancing corner heat distribution of the components comprising:

a first component and a second component, each of the first and second components being generally hollow and having at least two walls with an interior surface and an exterior surface, each of the at least two walls including a substantially planar region transitioning into a corner region, each substantially planar region having a wall thickness, the exterior surfaces of the at least two walls joining in the corner region to form an outer edge, each of the outer edges being shaped to reduce stagnation of fluid flow therearound, the interior surfaces of the at least two walls joining in the corner region to form an inner edge, the interior surfaces being arranged relative to the exterior surfaces to provide enhanced heat distribution properties in the corner regions of the components, wherein, in the corner region, the interior surface of each wall approaches the exterior surface such that the thickness at the inner edge is less than or equal to the wall thickness, whereby the adjacent outer edges allows reduce stagnation air flow around the first and second components and the thickness of the inner edge that is less than or equal to the wall thickness provides enhanced heat transfer properties.

11. A component having enhanced thermal distribution properties comprising:

a generally hollow body including an inner volume, wherein the inner volume is supplied with a coolant, the body having at least two walls adjoining each other in a corner region, each of the at least two walls having an interior surface and an exterior surface, each of the at least two walls including a substantially planar region transitioning into the corner region, each substantially planar region having a wall thickness, wherein the exterior surfaces of the at least two walls join in the corner region to form an outer edge and the interior surfaces of the at least two walls join in the corner region to form an inner edge, the distance between the inner edge and the outer edge defining an edge thickness, wherein, in the corner region, the interior surface of each wall approaches the exterior surface such that the edge thickness is less than or equal to the wall thickness.

12. The component of claim 11 wherein the component is substantially rectangular.

13. The component of claim 11 wherein the wall thicknesses of the at least two walls are substantially identical.

14. The component of claim 11 wherein the outer edge culminates in a substantially 90 degree edge.

15. The component of claim 11 wherein the outer edge culminates in a substantially rounded edge.

* * * * *